United States Patent [19]

Haugen

[11] 4,356,764

[45] Nov. 2, 1982

[54] PRESSURE ROLLERS FOR TONER FUSING STATION

[75] Inventor: Orville C. Haugen, Hennepin, Minn.

[73] Assignee: Minnesota Mining and Manufacturing Company, St. Paul, Minn.

[21] Appl. No.: 259,949

[22] Filed: May 4, 1981

[51] Int. Cl.[3] ..... B30B 3/04; B30B 3/06

[52] U.S. Cl. ..... 100/169; 100/157; 100/162 B; 100/176; 29/110; 29/116 AD; 29/121.8; 118/116; 355/3 FU

[58] Field of Search ..... 100/157, 158 R, 162 B, 100/176, 169, 160, 155 R; 29/110, 113 AD, 116 AD, 121.8; 118/116, 117, 60; 430/98, 99; 355/3 FU; 219/469; 432/60; 101/152, 153; 428/194

[56] References Cited

U.S. PATENT DOCUMENTS

| | | | |
|---|---|---|---|
| 3,055,083 | 9/1962 | Stobi | 100/162 B |
| 3,418,703 | 12/1968 | Thiry | 29/116 AD |
| 3,736,869 | 6/1973 | Motter | 101/153 |
| 4,001,544 | 2/1977 | Heinzer et al. | 432/60 X |
| 4,188,109 | 2/1980 | Idenawa et al. | 355/3 FU |
| 4,192,229 | 3/1980 | Tsunoi et al. | 100/162 B |
| 4,200,389 | 4/1980 | Matsui et al. | 29/121.8 X |

*Primary Examiner*—Peter Feldman

*Attorney, Agent, or Firm*—Cruzan Alexander; Donald M. Sell; John C. Barnes

[57] ABSTRACT

A pressure roller and apparatus for pressure fixing imaging powder in an electrostatic duplicating machine, the apparatus comprising a pair of fixing rollers in pressure contact along a narrow band to define a nip. The fixing rollers are hollow cylindrical rollers with parallel longitudinal axes and are rotatably supported by pressure transfer rollers inside each fixing roller. The pressure transfer rollers in each fixing roller are rotatably supported by a shaft and housing. Pressure supplied by loading means at the ends of the shafts to pressure fix imaging powder to a substrate transported through the nip is distributed uniformly along the nip by the pressure transfer rollers without causing bending moments on the fixing rollers.

15 Claims, 4 Drawing Figures

PRESSURE ROLLERS FOR TONER FUSING STATION

FIELD OF INVENTION

This invention relates to a pressure fusing station for pressure fusing imaging powder in an electrophotographic copying machine. More particularly, this invention relates to a pressure fixing apparatus in which a substrate having a surface with imaging powder formed thereon is passed between a pair of fixing rollers which are in pressure contact with each other to fix the powder on the substrate by pressure exerted by the fixing rollers.

DESCRIPTION OF PRIOR ART

Devices for pressure fixing toners are known in the art. A typical pressure fixing apparatus includes a nip defined as a narrow longitudinal area of contact formed by two rollers in pressure contact. Pressure fixing the toners is accomplished by passing substrates on which toner images have been placed through the nip.

In order to achieve reliable pressure fixing, it is necessary that a predetermined uniform pressure be applied by the nip to the substrate. However, it has been found that there are several factors causing pressure variations. The primary factor is the deflection of the rollers upon application of pressure to the rollers to form the nip. A conventional fixing roller has a step-down diameter at each end to allow engagement with a support bearing. The portion of the fixing roller disposed between the two ends defines the nip. Typically, pressure to form the nip is applied through the support bearings. Because of the smaller diameter at each end, there is a moment arm of a length equal to the axial spacing from the nip to the support bearing, the pivot point being the point on the nip adjacent the step-down portion of the fixing roller. Application of fixing pressure through the support bearings causes bending moments on the fixing rollers. Thus, when two conventional fixing rollers are aligned with their longitudinal axis parallel, application of pressure at the ends of the rollers results in bending moments which cause the rollers to deflect or bow at the center so that there is minimum fixing pressure at the center of the nip. Roller deflection or bowing at the center increases when a substrate is inserted in the nip. This results in uneven fixing of toners to the substrate. Higher pressures than are necessary to fix toners must be applied at the ends of the nip to assure adequate fixing pressure at the center of the nip.

There are devices in the prior art in which the rollers are skewed to compensate for the deflection of the fixing rollers. One or both of the fixing rollers may be rotated with respect to a line perpendicular to the path the substrate travels. Skewing the rollers allows the ends of the rollers to wrap around each other as they deflect under pressure, resulting in more uniform pressure along the nip. However, skewing the rollers results in forces which act on the substrate in a direction substantially perpendicular to the path the substrate travels. These lateral forces contribute undesired gloss to the substrate and result in the substrate tending to crease or curl during passage through the nip. Creasing or curling may cause jamming problems in devices handling the substrate after the fixing rollers, and may lead to tearing of the substrate. Another disadvantage is that such an apparatus is limited to pressure fixing at one pressure value. For example, higher pressure causes greater deflection in the rollers which requires a greater skew angle to avoid nonuniformity along the nip. There is also some additional cost in having the means supporting the rollers aligned with the skew.

Other expedients have been introduced in an attempt to overcome the problem of deflection of the fixing rollers upon application of force to the ends of the rolls. Larger diameter fixing rollers reduce but do not eliminate the deflection. A third roller in pressure contact with one of the fixing rollers may be used to provide fixing pressure by urging the third roller towards the nip. Another method suggested in the prior art is the use of a crowned roller. All of the foregoing features have the disadvantage of increasing the initial costs, operating costs, and the size of the apparatus.

SUMMARY OF THE INVENTION

The present invention provides a pressure fixing device in which there are no bending moments on the fixing rollers in parallel alignment thereby eliminating bowing between the ends thereof. The device is simple and inexpensive because the fixing rollers and means supporting the fixing rollers allow varying the fixing pressure without changing the angular alignment of the support means, as is required with skewed rollers. Creasing or curling of the substrate is also reduced with the device.

The present invention comprises a pair of hollow cylindrical fixing rollers aligned with their longitudinal axis parallel. The fixing rollers are rotatably supported by pressure transfer rollers inside each fixing roller on axes which are not coincident. The axis of each pressure transfer roller is parallel to the axis of the fixing roller and is offset in the direction of the nip so that the peripheral surface of the pressure transfer roller contacts the inner cylindrical surface of the fixing roller opposite the nip. Support means rotatably support the pressure transfer rollers; the support means also have their axes parallel to the fixing rollers and are offset in the direction of the nip. A loading means urging each of the support means towards the nip results in pressure contact between the support means and the pressure transfer rollers and between the pressure transfer rollers and the fixing rollers. When pressure is supplied at the ends of the support means, it is distributed across the fixing rollers and the nip by the pressure transfer rollers. Although pressure will cause deflection of the support means, bending moments on the fixing rollers are eliminated.

DETAILED DESCRIPTION OF THE INVENTION

Figure 1:
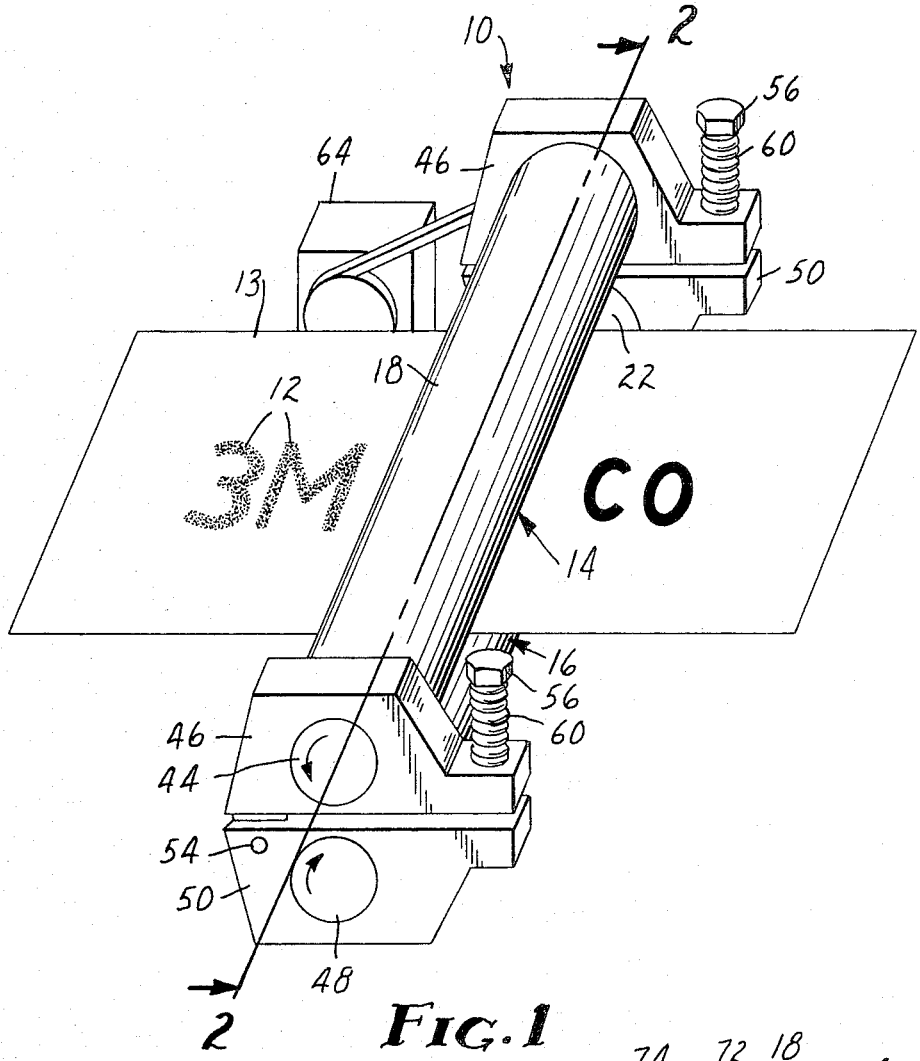
FIG. 1 is a perspective view of an apparatus according to the present invention.

Referring to the drawings, an apparatus 10 is shown providing means for pressure fixing imaging powder 12 in an electrophotographic copying machine. The apparatus 10 comprises a pair of hollow cylindrical fixing rollers 14 and 16 aligned with their longitudinal axes parallel and coplanar. Fixing roller 14 has an outer cylindrical surface 18 and spaced coaxial inner cylindrical surfaces 20. Fixing roller 16 has an outer cylindrical surface 22 and spaced coaxial inner cylindrical surfaces 24. A central cylindrical wall 21 in roller 14 and wall 25 in roller 16 separate the respective surfaces 20 and 24 and define axially spaced shoulders within the rollers. The outer cylindrical surfaces 18 and 22 contact along a narrow longitudinal band to define a nip 26. A toner powder image 12, carried on substrate 13, is pressure fused to the substrate by passing the substrate through the nip 26.

Figure 3:
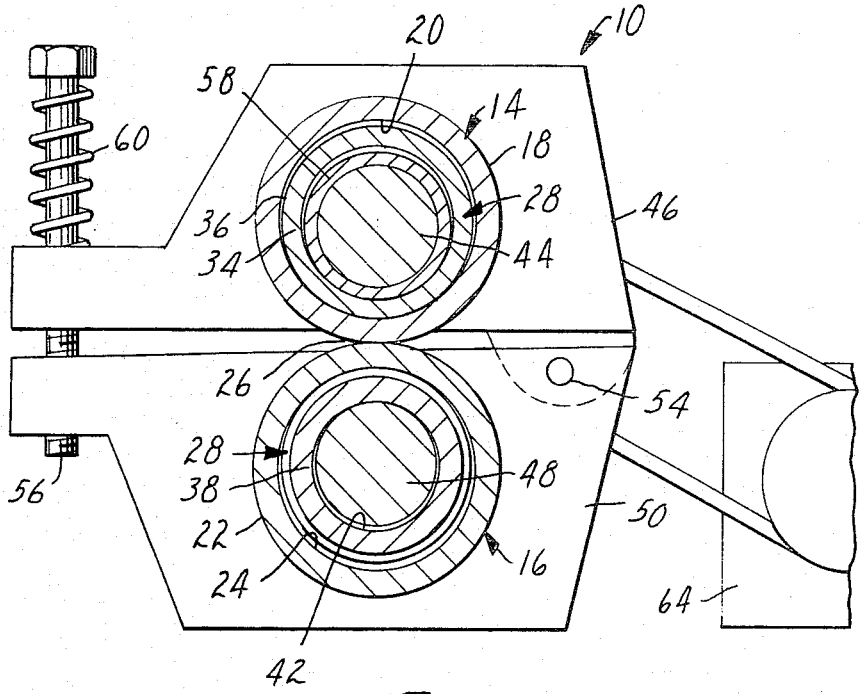
FIG. 3 is a sectional view of the apparatus of FIG. 2 taken along line 3—3. Portions of the axial spacers on the shafts have been omitted for clarity.
Figure 2:
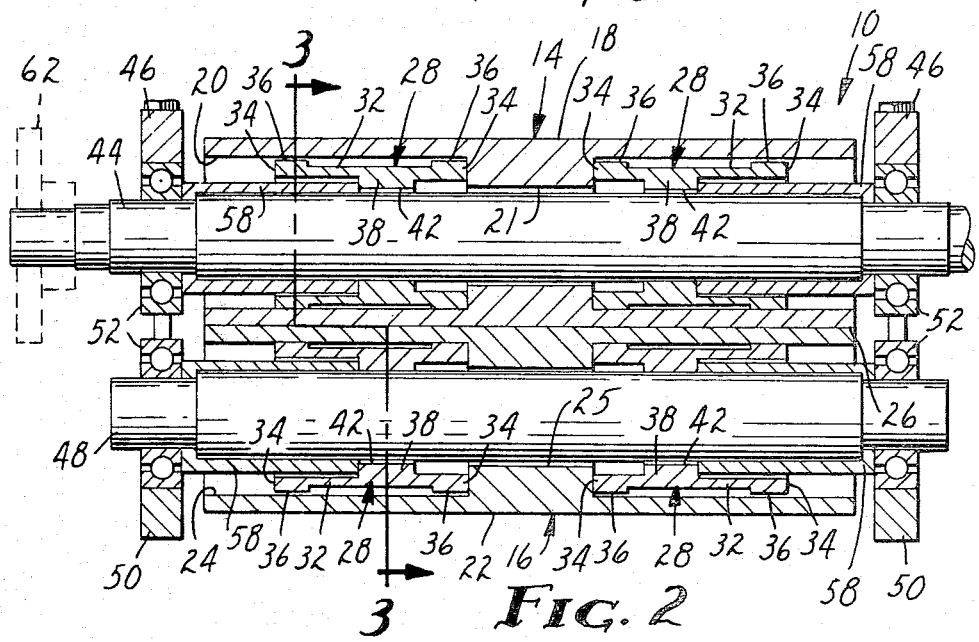
FIG. 2 is a sectional view of the apparatus of FIG. 1 taken along line 2—2.

Referring to FIGS. 2 and 3, there are pressure transfer rollers 28 inside fixing rollers 14 and 16 providing means affording uniform application of pressure along nip 26. Each pressure transfer roller 28 comprises walls defining a cylindrical body 32 having a longitudinal axis. Axially spaced narrow cylindrical radial projections 34 extend radially out from the cylindrical body 32. The radial projections 34 have cylindrical peripheral surfaces 36 coaxial with the longitudinal axis of the cylindrical body 32, and a center support member 38 having an inner bearing surface 42 coaxial with the longitudinal axis of the cylindrical body 32 and surface 36. Each fixing roller, 14 and 16, has two transfer rollers 28 disposed therein with the transfer rollers abutting the central shoulders.

Support means comprising shaft 44 and upper housings 46 rotatably support pressure transfer rollers 28 inside fixing roller 14. Similarly, shaft 48 and lower housings 50 rotatably support pressure transfer rollers 28 inside fixing roller 16. Shafts 44 and 48 are rotatably mounted in parallel alignment in housings 46 and 50 by bearings 52. Pin 54 pivotally connects housings 46 and 50. Drive means for rotating shaft 44 are also provided so that a substrate may be transported through the fixing rollers 14 and 16. This includes a drive sprocket 62 and suitable chain or belt leading from a drive motor 64 as shown in FIGS. 2 and 3.

Axial spacers 58, known in the prior art, are used to maintain axial alignment of the pressure transfer rollers 28 and the fixing rollers 14 and 16. These axial spacers 58 are disposed on both ends of the shafts 44 and 48 and engage the center support member 38 of the pressure transfer rollers 28, as shown in FIG. 2. For clarity, a portion of the axial spacers has been omitted from FIG. 3.

Loading means for urging the shafts 44 and 48 towards the nip 26 and adjusting pressure at the nip 26 comprises threaded posts 56, and springs 60.

Referring to FIGS. 2 and 3, tightening threaded posts 56 causes shaft 44 to move toward shaft 48 and results in pressure contact inside fixing roller 14 between shaft 44 and inner bearing surfaces 42 of pressure transfer rollers 28, and between the peripheral surfaces 36 of pressure transfer rollers 28 and inner cylindrical surface 20 of fixing roller 14. Similarly, there is pressure contact inside fixing roller 16 between shaft 48 and inner bearing surfaces 42 of pressure transfer rollers 28 and inner cylindrical surface 24 of fixing roller 16. The longitudinal axis of shafts 44 and 48 and pressure transfer rollers 28 remain parallel to the longitudinal axis of fixing rollers 14 and 16, but are offset from the longitudinal axis of fixing rollers 14 and 16, towards nip 26. In operation, threaded posts 56 are further tightened to effect the desired fixing pressure at nip 26. Due to the pressure contact between fixing rollers 14 and 16, and pressure transfer rollers 28, and shafts 44 and 48, drive means 62 rotating shaft 44 results in rolling contact between the foregoing elements and effects rotation of the pressure rollers 28 and the fixing rollers 14 and 16 in a manner similar to internal gearing. The rolling contact causes the driven shaft 44 to act like a pinion driving the pressure roller 28. In turn, rolling contact causes the pressure roller 28 to act like a pinion driving the fixing roller 14. The fixing roller 14 then drives the fixing roller 16.

Pressure exerted at the ends of shafts 44 and 48 by springs 60 through housings 46 and 50 and bearings 52 is distributed to inner cylindrical surfaces 20 and 24 of the fixing rollers 14 and 16 through peripheral surfaces 36 of fixing rollers 28. Since pressure is applied at opposing colinear locations defined by peripheral surfaces 36, there are no bending moments on fixing rollers 14 and 16. The axial spacing of peripheral surfaces 36 affords uniform transfer of pressure along nip 26.

Fixing rollers 14 and 16 need not be skewed to compensate for bowing at the center so that housings 46 and 50, and bearings 52 are manufactured in simple parallel alignment. Furthermore, an increase or decrease in desired fixing pressure is made by adjusting threaded posts 56, and does not require re-alignment of housings 46 and 50, or fixing rollers 14 and 16.

Preferably, pressure transfer rollers 28 are made of steel. Also, the diameter of peripheral surfaces 36 of pressure transfer rollers 28 are preferably in the range of from 0.002 to 0.006 inch (0.0508 to 0.1524 mm) less than the diameter of inner cylindrical surfaces 20 and 24 of fixing rollers 14 and 16.

In one embodiment, both outer cylindrical surfaces 18 and 22 are made from a rigid material, such as steel. In another embodiment to suit a different substrate material, one of the outer cylindrical surfaces is made from an elastic material such as rubber of about 35-60 durometer.

Figure 4:
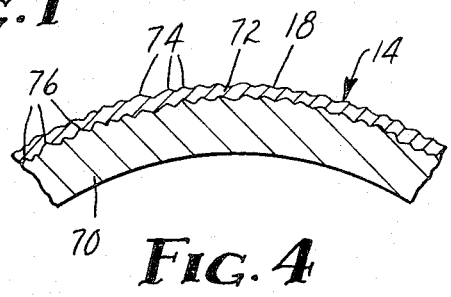
FIG. 4 is an enlarged fragmentary transverse sectional view showing another embodiment of the invention.

In still another embodiment, the fixing roller 14 comprises a core 70 and a layer 72 which defines outer cylindrical surface 18. As shown in sectional view in FIG. 4, layer 72 provides a plurality of randomly sized domed projections 74. Fixing roller 14 having core 70 and layer 72 may be prepared by conventional processing techniques. For example, core 10 may be a rigid cylindrical roll, such as a steel roll, having its surface roughened by, for example, sand blasting with 100 grit abrasive material. This provides a plurality of sharp peaks 76 shown in FIG. 4. This rough surface is then coated with layer 72 to provide the random sized domed projections 74. This may be done with conventional plating techniques using conventional plating materials. Preferably layer 72 is in the range of from about 0.01 to 0.1 mm thick. Most preferably, the material of layer 72 is chrome.

The preceding disclosure describes the more preferred embodiments of the present invention. However, minor variations of the invention are possible and will be obvious to those skilled in the art as a result of this disclosure. These variations are included within the scope of the accompanying claims.

I claim:

1. A pressure fixing apparatus for pressure fixing a toner powder image to a substrate in an electrophotographic copying machine, which comprises:

a pair of hollow cylindrical fixing rollers having their longitudinal axes parallel and coplanar, said fixing rollers each having an outer cylindrical surface and an inner cylindrical surface, said outer cylindrical surfaces being in pressure contact along a narrow band parallel to the axes of said fixing rollers to define a nip for pressure fixing toner powder to a substrate; and a drive assembly for rotating said fixing rollers and for rotatably supporting said fixing rollers in uniform pressure contact along said nip, said drive assembly comprising:

pressure transfer rollers inside said fixing rollers for transferring driving torque to rotate said fixing rollers and for maintaining uniform pressure at said nip, each pressure transfer roller comprising walls defining:

a hollow cylindrical body having a longitudinal axis defining the longitudinal axis of said pressure transfer roller; and a plurality of axially spaced cylindrical radial projections extending radially out from said cylindrical body, said radial projections having cylindrical peripheral surfaces coaxial with said longitudinal axis of said pressure transfer roller and having a diameter less than the diameter of said inner cylindrical surface of said fixing rollers, for pressure engagement with said inner cylindrical surface of said fixing roller;

support means for engaging and transferring pressure and driving torque to said pressure transfer rollers and for rotatably supporting said pressure transfer rollers inside said fixing rollers so that said longitudinal axes of said pressure transfer rollers are in parallel alignment with said nip;

loading means for urging said support means toward said nip, said loading means effecting pressure contact between said support means and said pressure transfer rollers and said fixing rollers thereby effecting desired pressure uniformly along said nip, and drive means for rotating said support means at a predetermined velocity, wherein said pressure contact together with rotation of said support means effects rolling contact between said support means and said pressure transfer rollers and between said pressure transfer rollers and said fixing rollers whereby rotation of said support means effects simultaneous rotation of said pressure transfer rollers and said hollow cylindrical rollers.

2. A pressure fixing apparatus according to claim 1, wherein said outer cylindrical surfaces of said fixing rollers are made from rigid materials.

3. A pressure fixing apparatus according to claim 1 wherein one of said outer cylindrical surfaces of said fixing rollers is made from elastic material.

4. A pressure fixing apparatus according to claim 1 wherein one of said outer cylindrical surfaces of said fixing rollers has an irregular surface comprising a plurality of randomly sized domed shaped projections that contact the imaged surface of the substrate.

5. A pressure fixing apparatus according to claim 1 wherein said pressure transfer rollers are made of steel.

6. A pressure fixing apparatus according to claim 1, wherein said support means comprises a shaft through said pressure transfer rollers in each of said fixing rollers, said shafts having longitudinal axes parallel to said nip, and a housing for rotatably supporting said shafts and for affording movement of said shafts toward said nip.

7. A pressure fixing apparatus according to claim 6 wherein the axes of said shafts are parallel to the axes of said pressure transfer rollers and offset toward said nip from the axes of said transfer rollers.

8. A pressure fixing apparatus according to claim 1 wherein said peripheral surfaces of said pressure transfer rollers have a diameter 0.002 to 0.006 inch (0.0508 to 0.1524 mm) less than the diameter of said inner cylindrical surface of said fixing rollers.

9. A pressure fixing apparatus according to claim 6 wherein said drive means comprises a drive motor coupled with one of said shafts so that rotation of said drive motor causes rotation of said shafts and said pressure transfer rollers supported thereby.

10. A pressure fixing apparatus according to claim 1 wherein said pressure transfer rollers further include a center support member inside said hollow cylindrical body, said center support member having an inner bearing surface coaxial with said longitudinal axis of said pressure transfer roller for pressure engagement with said support means.

11. A pressure roller assembly comprising a hollow cylindrical roller and means for rotatably supporting said hollow cylindrical roller in pressure contact with a base surface, said hollow cylindrical roller having a longitudinal axis, an outer coaxial cylindrical surface and a plurality of coaxial inner cylindrical surfaces, said outer cylindrical surface contacting said base surface along a narrow band parallel to said longitudinal axis to define a nip, said means for rotatably supporting said hollow roller comprising:

pressure transfer rollers inside said hollow cylindrical roller for transferring driving torque to rotate said hollow cylindrical roller and for maintaining uniform pressure at said nip, each pressure transfer roller comprising walls defining:

a hollow cylindrical body having a longitudinal axis defining the longitudinal axis of said pressure transfer roller; and a plurality of axially spaced cylindrical radial projections extending radially out from said cylindrical body for pressure engagement with said inner cylindrical surfaces of said hollow cylindrical roller, said radial projections having cylindrical peripheral surfaces coaxial with said longitudinal axis of said pressure transfer roller and having a diameter less than the diameter of said inner cylindrical surfaces of said hollow cylindrical roller;

support means for engaging and transferring pressure and driving torque to said pressure transfer rollers and for rotatably supporting said pressure transfer rollers inside said hollow cylindrical roller so that said longitudinal axes of said pressure transfer rollers are in parallel alignment with said nip;

loading means for urging said support means toward said nip, said loading means effecting pressure contact between said support means and said pressure transfer rollers and pressure contact between said pressure transfer rollers and said hollow cylindrical rollers thereby effecting desired pressure uniformly along said nip, and drive means for rotating said support means at a predetermined velocity, wherein said pressure contact together with rotation of said support means effects rolling contact between said support means and said pressure transfer rollers and between said pressure transfer rollers and said hollow cylindrical roller so that rotation of said support means effects simultaneous rotation of said pressure transfer rollers and said hollow cylindrical roller.

12. A pressure roller assembly according to claim 11, wherein said support means comprises a shaft through said pressure transfer rollers inside said hollow cylindrical roller, said shaft having its longitudinal axis parallel to said nip, and a housing for rotatably supporting said shaft and affording movement of said shaft toward said nip.

13. A pressure roller assembly according to claim 11 wherein said cylindrical peripheral surfaces of said pressure transfer rollers have a diameter 0.002 to 0.006 inch (0.0508 to 0.1524 mm) less than the diameter of said inner cylindrical surface of said hollow cylindrical roller.

14. A pressure roller assembly according to claim 12 wherein said drive means comprises a drive motor coupled with said shaft so that rotation of said drive motor causes rotation of said shaft and said pressure transfer rollers supported thereby.

15. A pressure roller assembly according to claim 11 wherein said pressure transfer rollers further include a center support member inside said hollow cylindrical body, said center support member having an inner bearing surface coaxial with said longitudinal axis of said pressure transfer roller for pressure engagement with said support means.

* * * * *